US008033056B2

(12) United States Patent
Wernlund et al.

(10) Patent No.: US 8,033,056 B2
(45) Date of Patent: Oct. 11, 2011

(54) DOORWAY WITH ANTI-BUBBLING SILL DRAIN

(75) Inventors: Chad Wernlund, Baldwin, WI (US); Jon Dekko, Grant, MN (US); Duane Fier, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 386 days.

(21) Appl. No.: 12/069,623

(22) Filed: Feb. 12, 2008

(65) Prior Publication Data

US 2009/0199486 A1 Aug. 13, 2009

(51) Int. Cl.
*E06B 7/14* (2006.01)

(52) U.S. Cl. ..... 49/408; 49/471; 52/209

(58) Field of Classification Search ..... 49/408, 49/467, 471; 52/209, 204.52
See application file for complete search history.

(56) References Cited

U.S. PATENT DOCUMENTS 2,795,018 A * 6/1957 Shaw ..... 65/36
3,410,027 A * 11/1968 Bates ..... 49/471
3,845,599 A * 11/1974 Jolly ..... 52/209
5,596,151 A * 1/1997 Rossini ..... 73/861.55
5,687,508 A * 11/1997 Fitzhenry et al. ..... 49/471
6,374,557 B1 * 4/2002 O'Donnell ..... 52/209
7,600,346 B2 * 10/2009 Meeks ..... 49/471

* cited by examiner

*Primary Examiner* — Jerry Redman
(74) *Attorney, Agent, or Firm* — Womble Carlyle Sandridge & Rice PLLC

(57) ABSTRACT

A doorway with anti-bubbling sill drain includes spaced vertical side jambs, a head jamb, and a substantially hollow contain-and-drain sill, all of which form a frame. The sill has an outside nosing provided with weep holes and weep doors and a threshold portion that directly underlies a closed door mounted in the frame. A drain insert is mounted within an oblong hole in the threshold portion of the sill for allowing water collected on the threshold portion to drain into the sill and for allowing air within the sill to vent. The drain insert has a top cover, from the end portions of which a pair of drains depend. The tops of the drains are spaced from the underside of the top cover to form drain entrances. An open vent space is formed between the two drains and terminates at its upper extent in drain holes formed through the top cover. When installed, the drains extend down into the interior of the sill with the drain entrances being flush with the floor of the threshold portion. Water on the threshold portion drains into the drain entrances and through the two drains into the sill while air escaping from within the sill vents through the separate vent space and vent holes above. Percolation and bubbling at the drain location is thus eliminated.

9 Claims, 6 Drawing Sheets

DOORWAY WITH ANTI-BUBBLING SILL DRAIN

TECHNICAL FIELD

This invention relates generally to doorways and more specifically to doorways with contain-and-drain sills.

BACKGROUND

Entry doors, patio doors, and the like generally include a pair of spaced vertical side jambs, a head jamb or header extending between the upper ends of the side jambs, and a door sill extending between the bottom ends of the side jambs. Hinged or sliding door panels are mounted within the resulting frame and, when closed, directly overly a threshold portion along the inside of the sill. Many hinged entry doors open into a building in which they are mounted and thus are know as in-swing doors. A variety of sill configurations are available for use with entry doors including wooden sills, aluminum sills, plastic sills, composite sills, and the like.

One type of sill used for entry doors is known as a "contain-and-drain" sill. In general, a contain-and-drain sill typically is extruded from plastic or a composite material and is generally hollow inside with, perhaps, some longitudinal support ribs, which form chambers inside the sill. Openings are formed in the support ribs communicating between adjacent chambers. The ends of the sill are sealed with an end cap and one or more weep holes, which may be provided with weep doors or flaps, are formed along the outside nosing of the sill communicating between its hollow interior and the outside.

Under various conditions, water can collect on the threshold portion of the sill beneath a closed door. For example, rainwater can leak past the weather seals or snow from shoes can be deposited on the sill and melt. In order to manage this water, it is known to provide one or more drains in the threshold portion of the sill through which water can drain into the hollow interior of the sill. Once contained within the interior of the sill, the water can drain out of the sill through the weep holes formed along its outside nosing. Such drains also function as vents that help to equalize pressure differentials between the outside of a doorway and the inside of a building and vent air displaced by rising water in the sill.

A major problem with contain-and-drain sills can arise when it rains in high wind conditions, i.e. when the doorway is under high "DP" loads. The high winds can raise the air pressure on the exterior of a doorway relative to the interior of the doorway, thus creating a partial vacuum within the hollow interior of the sill. As used herein, the term "partial vacuum" means that there exists a negative pressure differential between the outside of the doorway and the hollow interior of the door sill. The partial vacuum, in conjunction with rain water that tends to build up around the sill, can cause air and water to be sucked through the weep holes into the interior of the sill, which can begin to fill with water and bubbles. The water generally rises until the head of water within the sill equals the pressure differential between the outside and inside of the doorway.

As the water level rises within the sill, the air that is displaced by the water, as well as air being sucked into the sill by the partial vacuum, must escape the sill and generally does so through the drains in the threshold portion of the sill. Often, and particularly in driving rains, there is collected water in the threshold portion, which is draining into the interior of the sill through the drains. The simultaneously escaping air through these drains causes percolation and bubbling of the water at the locations of the drains. Even when there is no collected water on the threshold portion of the sill, percolation and bubbling can still occur as a result of bubbles that develop within the sill due to the mixture of water and air being sucked in.

Bubbling and percolation at the drains can result in water leakage into a dwelling, which can cause damage and can cause a doorway to fail to meet building standards for water resistance. It has been known to add vents up the side jambs or in some other remote area of the door unit through which air in the sill can escape. However, it is not always possible to vent to a remote location and, when it is not, venting commonly occurs through the drains resulting in bubbling. Even when air is vented remotely, the result may not always be completely satisfactory.

A need therefore exists for a doorway with a contain-and-drain sill that effectively contains and allows water to rise within the sill under high wind load conditions without percolation and bubbling of the water and air at drain locations. A further need exists for such a doorway that drains water effectively into the interior of the sill from the threshold portion of the sill without percolation or bubbling occurring at the drain site. It is to the provision of such a doorway that the present invention is primarily directed.

SUMMARY

Briefly described, the present invention, in a preferred embodiment thereof, is a doorway having spaced vertical side jambs, a head jamb, and a sill, which together form a frame. At least one door panel is mounted in the frame for opening and closing the doorway. The sill of the doorway is of the contain-and-drain type, which has a substantially hollow interior and is sealed at its ends to form a chamber inside. The sill includes an outside nosing provided with weep holes, which may have weep doors installed therein, to allow water collected in the hollow interior of the sill to drain through the weep holes in the outside nosing. The sill further has a threshold portion that directly underlies a closed door panel of the doorway and that is configured to collect water that may seep past weather seals, result from melting snow, or otherwise make its way to the threshold portion of the sill.

At least one elongated hole is formed in the threshold portion of the sill and a drain insert, configured according to the invention, is disposed within the hole. The drain insert has a planar top cover provided in its mid portion with an array of vent holes. Drains having central drain passages depend from each end portion of the top cover and the tops of the drains are spaced slightly below the top cover to define drain entrances. The drains are vertically separated by a vent space beneath the central portion of the top cover. When installed, the top cover and vent holes are supported above the floor of the threshold portion of the sill and the separate drain entrances are at the floor level. The drains extend into the hollow interior of the sill to a position just above the bottom floor of the chamber inside.

When the doorway is under load in a blowing rainstorm, the pressure on the outside of the doorway rises above that on the inside. This creates a partial vacuum inside the sill, which tends to suck water and air and form bubbles in the sill. Further, water can seep between the closed door and the weather seals against which it is closed and collect in the threshold portion of the sill. This water on the threshold portion flows beneath the top cover and through the drain entrances of the drain insert, from which it is directed by the drains into the hollow interior of the sill. At the same time, air displaced by rising water and air sucked into the sill by the pressure differential must escape, and does so through the vent space and vent holes in the drain insert according to the invention. However, since water from the threshold portion flows into the sill through the drains of the drain insert and air escapes through the separate vent space and vent openings, the escaping air does not flow through the draining water. As a consequence, bubbling at the drain location, common in the prior art, is eliminated. The top cover and vent holes of the drain insert are supported above the maximum level of collected water in the threshold portion of the sill, meaning that water can never overflow the vent holes resulting in bubbling.

In addition, bubbling caused from bubbles inside the sill is eliminated since as the water in the sill rises, it quickly submerges and cuts off the bottom ends of the drains. This eliminates turbulence and percolation that otherwise might occur at this location. Further, since pressure within the chamber is constantly relieved through the vent space and vent holes far above, pressure, which might otherwise cause burping and gurgling through the drains, is eliminated. Thus, bubbling and percolating at the drain location from this source also is eliminated.

The end result is a doorway with a contain-and-drain sill that exhibits virtually no percolation, burping, or bubbling at the locations of drains in the threshold portion of the sill. The consequent leakage of water into a dwelling and difficulty meeting DP standards and requirements is thus virtually eliminated.

Accordingly, a doorway with contain-and-drain sill is not provided that addresses successfully the problems and shortcomings of the prior art by eliminating bubbling and percolation at the location of threshold drains and vents. These and other features, objects, and advantages of the invention will be better understood upon review of the detailed description presented below taken in conjunction with the accompanying drawing figures, which are briefly described as follows.

DETAILED DESCRIPTION

Figure 1:
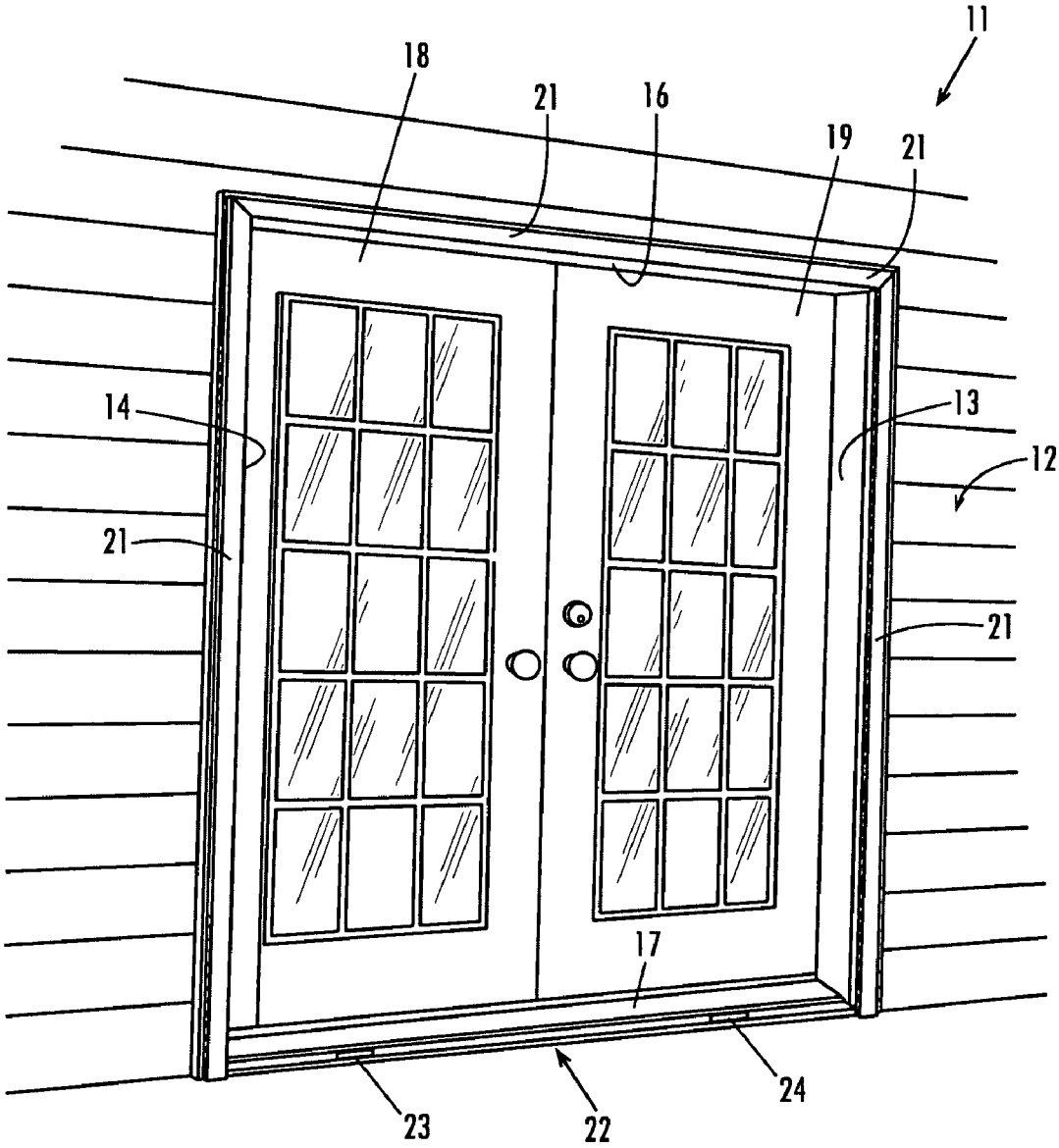
FIG. 1 is a perspective view of a doorway that embodies principles of the invention in one form.

Referring now in more detail to the drawing figures, wherein like reference numerals indicate like parts throughout the several views, FIG. 1 illustrates a doorway that embodies principles of the invention in one form. The doorway 11 is installed in a wall 12 of a building structure and has spaced vertical side jambs 13 and 14 spanned at their top ends by a horizontal head jamb 16. An elongated sill 17, which is of the substantially hollow contain-and-drain type, spans the bottom ends of the side jambs 13 and 14 and has an outside edge or nosing 22. Weep holes or openings 23 and 24 are formed along the nosing 22 and communicate with the hollow interior of the sill 17 to allow drainage of water from inside the sill. Weep doors or flaps preferably are installed in the weep holes 23 and 24 and are designed to close in the presence of high wind to prevent too much wind and water from blowing directly into the weep holes 23 and 24. Door panels 18 and 19 are hingedly mounted to the side jambs 14 and 13 respectively and are shown in their closed configurations with the bottom edges of the doors directly overlying a threshold portion 27 (FIG. 2) along the inside of the sill 17. The doors 18 and 19 open and swing inwardly into the dwelling and thus are referred to as in-swing doors. While double French inswing doors are illustrated in FIG. 1, other doorway configurations such as a single entry door, a sidelight door, a patio door, or otherwise also may be used with and benefit from the present invention.

Figure 2:
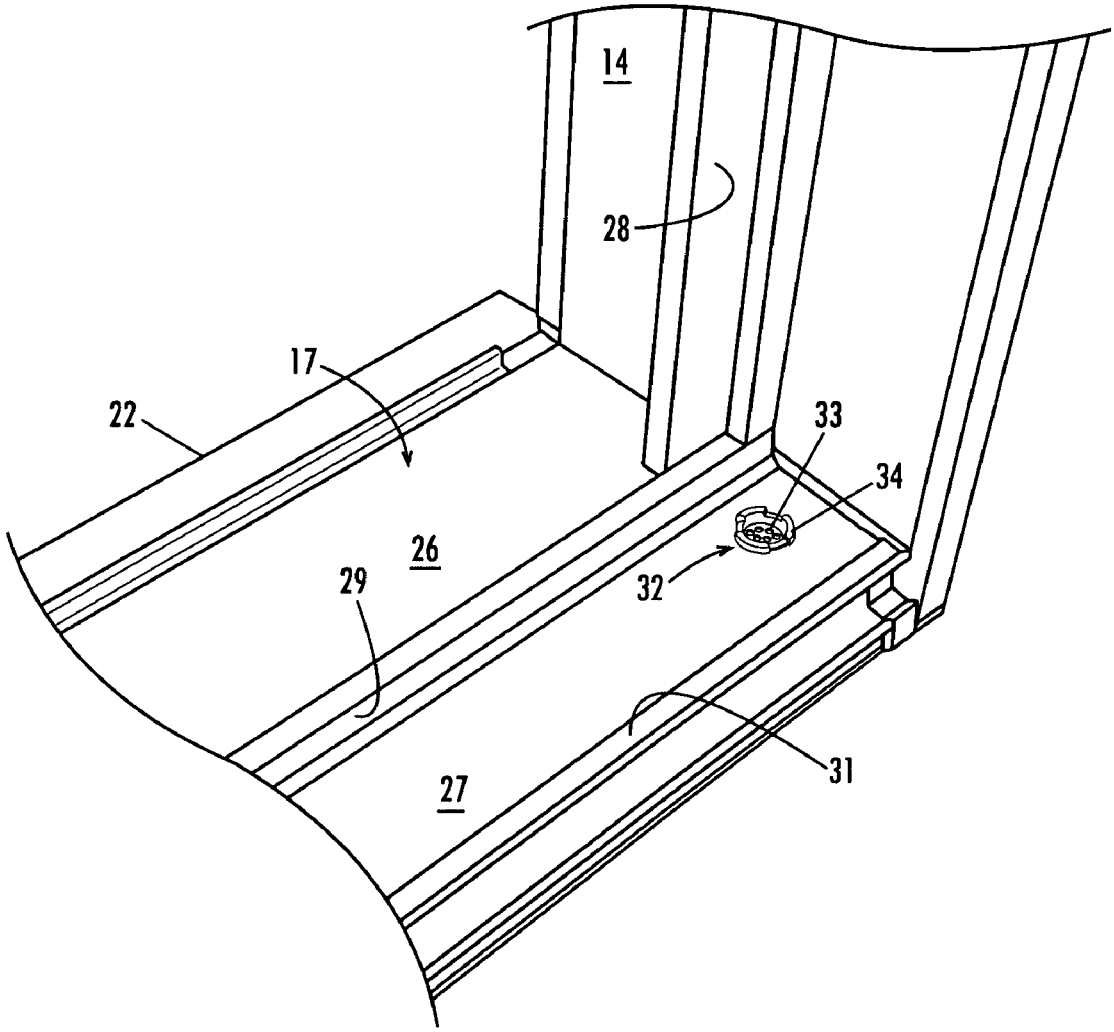
Fig. 2 (Prior Art)
FIG. 2 is a perspective view of a section of a prior art contain-and-drain sill illustrating a drain in the threshold portion of the sill.

FIG. 2 illustrates a typical prior art contain-and-drain sill configuration and shows a portion of the sill and a portion of a side jamb to which it is connected with the door panel omitted for clarity. The sill 17 has an exterior sill deck 26 and a threshold portion 27 that extends along the interior of the sill. The sill deck 26 and threshold portion 27 are separated by an upstanding weather seal surface 29, which may be provided with a weather strip and against which the door panel closes. The threshold portion 27 is bounded along the extreme interior edge of the sill by a slightly upstanding lip or rim 31 that is a bit higher than the floor of the threshold portion 27. The sill 17 is sealed at its ends with end blocks and gaskets (not visible in FIG. 2) and each end of the sill is secured to the bottom end of a corresponding side jamb 14. Side jamb 14 also has a projecting weather seal surface 28 to which may be mounted a weather strip designed to seal around a door of the doorway when closed. Various other profiles and configurations are known in the art, that of FIG. 2 being only exemplary.

A drain cover 32, according to the prior art, is mounted in a drain hole formed in the floor of the threshold portion 27. The drain cover 32 in the illustrated embodiment is formed with a plurality of holes 33 in its somewhat depressed central portion. The central portion, in turn, is surrounded by a segmented circular rim 34 with the segments of the rim being separated by spaces through which water may flow into the central portion of the drain cover and through the holes 33. It will be understood that the drain cover 32 functions both as a drain through which water may flow into the interior of the sill and as a vent through which air may flow out of the interior of the sill when there is a pressure differential or when water is rising inside the sill. As described in detail above, this dual function of the drain cover results inevitably in highly undesirable percolation and bubbling at the location of the drain cover, either as a result of escaping air flowing through water draining into the drain or bubbles forming in water rising inside the sill and blowing out through the drain. In either case, water can leak, as a result of the splashing caused by bubbling, into the interior of a building causing moisture damage, rot, and other undesirable consequences.

Figure 3:
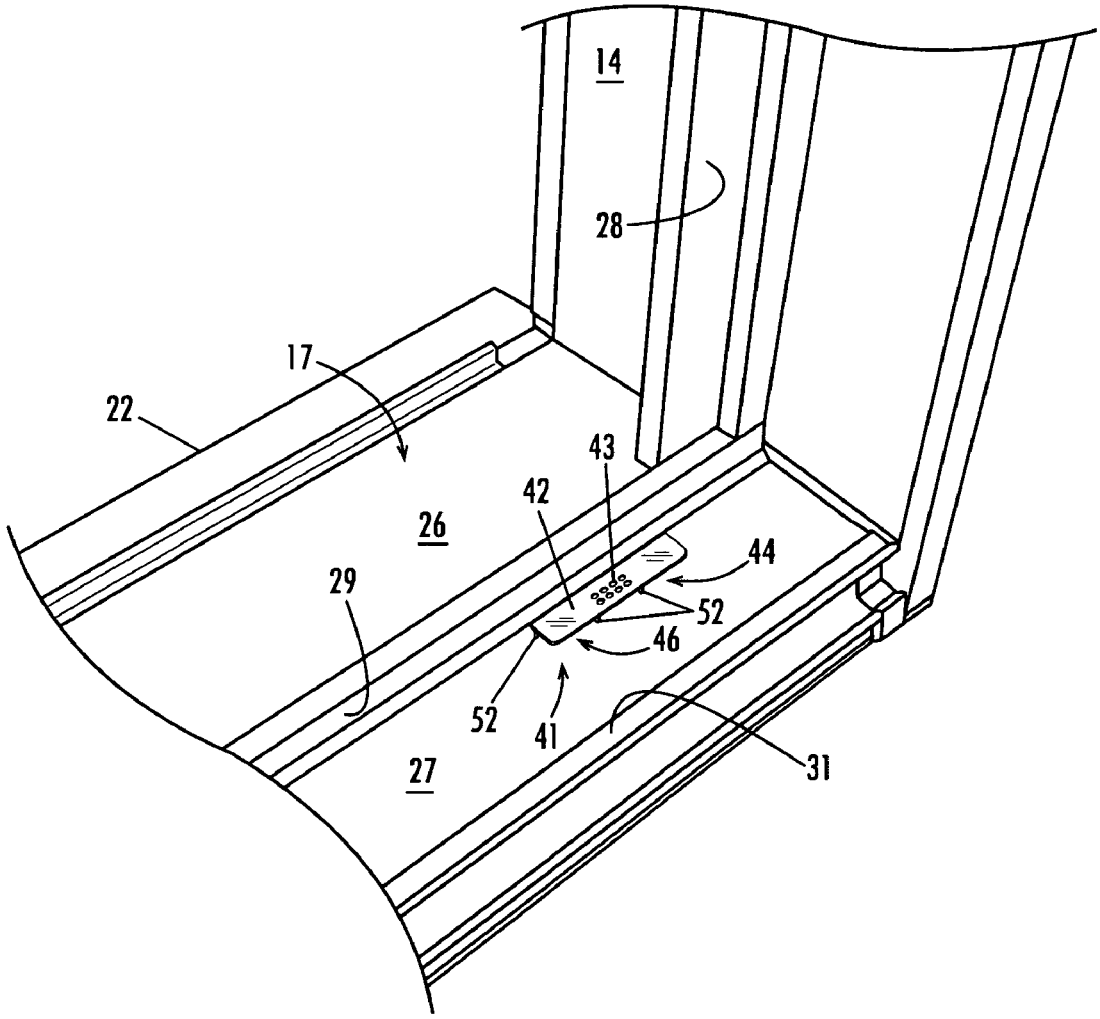
FIG. 3 is a perspective view of a section of a contain-and-drain sill that includes a drain insert configured according to one aspect of the present invention installed in the threshold portion of the sill.

FIG. 3 illustrates the contain-and-drain door sill of FIG. 2 equipped with a drain insert according to the present invention. The major components of the sill 17 and side jamb 14 are the same as in FIG. 2 and thus need not be described again in detail here. The sill 17 includes a threshold portion 27 bounded along the inside edge of the sill by inside lip or rim 31 that projects slightly higher than the floor of the threshold portion to contain water. A drain insert 41, configured according to the invention, is disposed in an oblong hole (not visible)

formed in the floor of the threshold portion 27. The drain insert 41 has a top cover 42 that resides above the floor of the threshold portion 27 and that is provided with an array of vent holes 43 in a central vent portion. Standoffs 52 depend from the top cover and rest on the floor of the threshold portion 27 to space the top cover from the floor of threshold portion 27. Drain entrances 44 and 46 are defined beneath the end portions of the top cover 42 and are designed, as detailed below, to direct water collected on the threshold portion 27 into the drains of the insert and thence into the hollow interior of the contain-and-drain sill 17.

Figure 4:
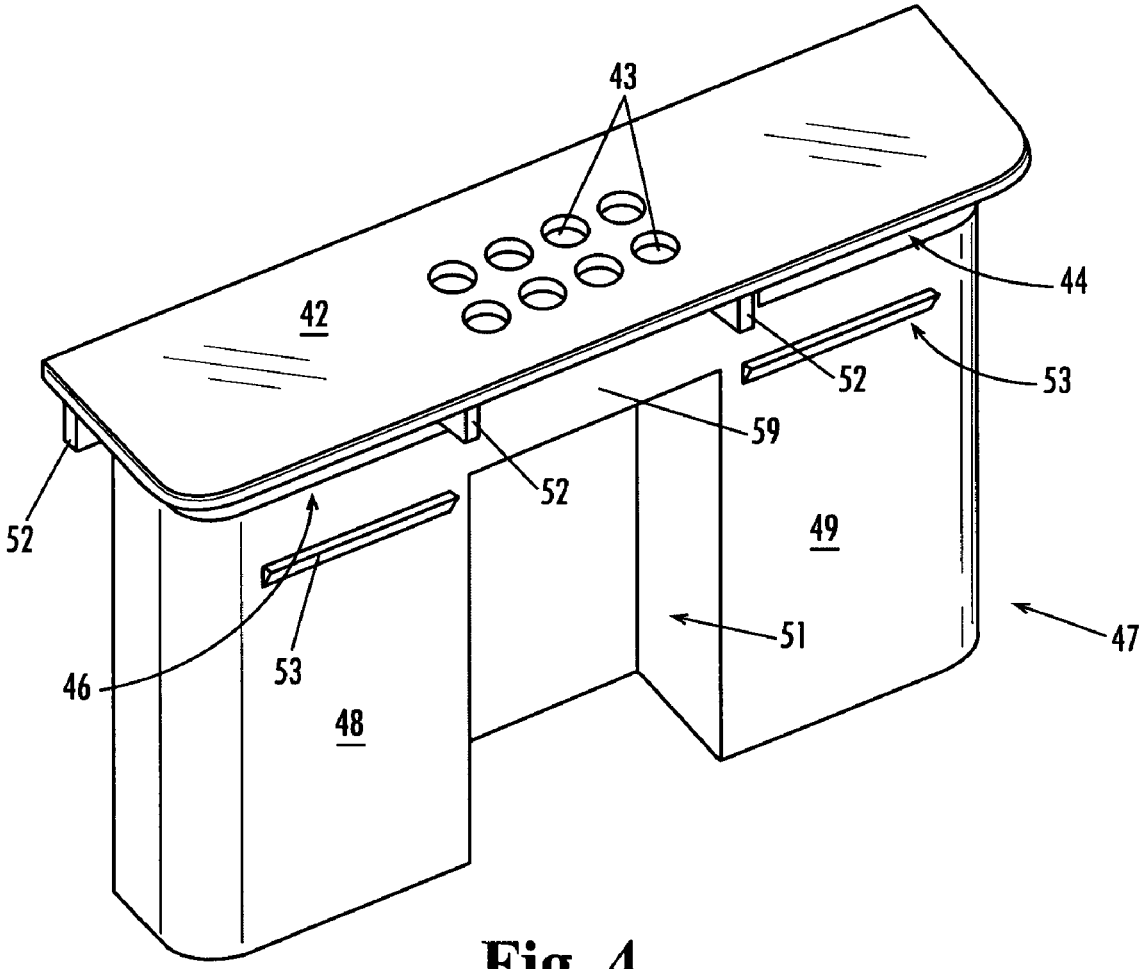
FIG. 4 is a perspective view of a drain insert that embodies principles of the invention.
Figure 5:
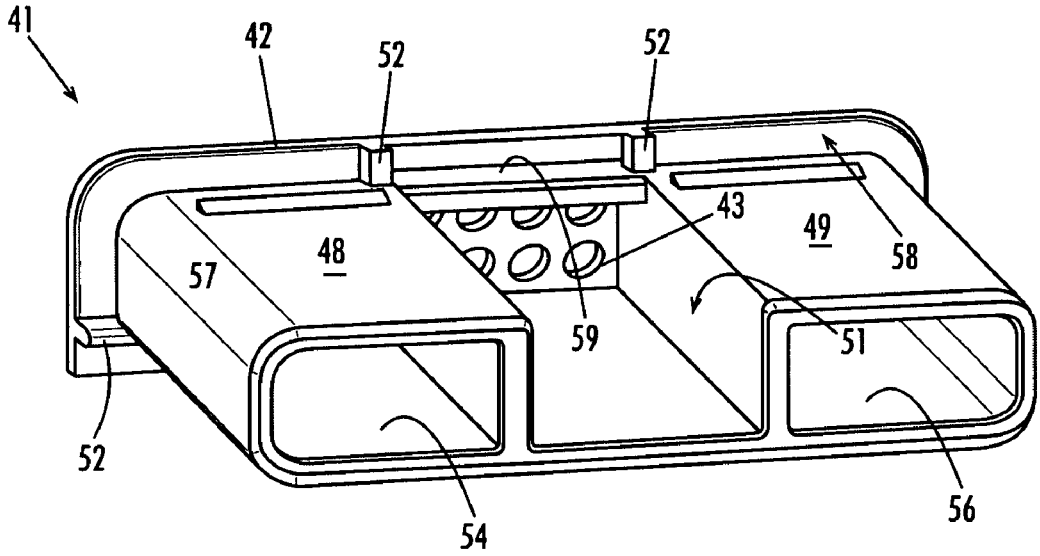
FIG. 5 is a perspective view of the bottom end portion of the drain insert of FIG. 4 illustrating the drain passages flanking the central vent of the insert.
Figure 6:
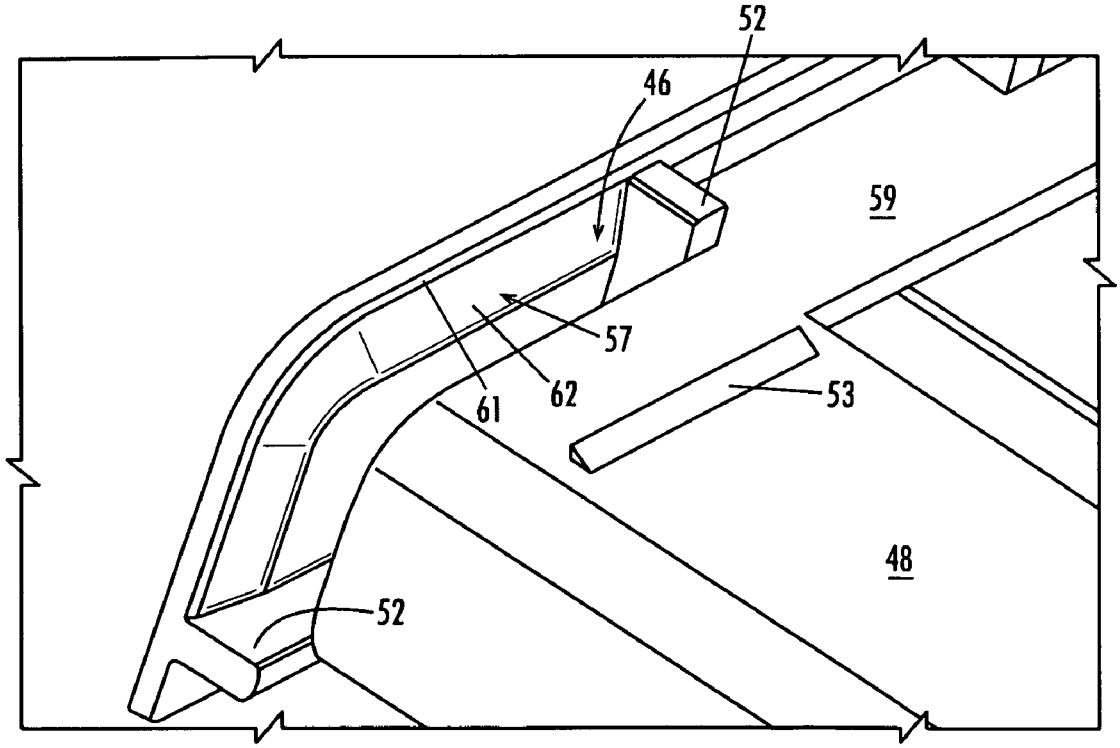
FIG. 6 is an enlarged perspective view illustrating the mouth of one of the drain passages of the invention.

FIGS. 4-6 illustrate the drain insert of this invention in more detail. The drain insert 41 has a top cover 42 provided with vent holes 43 in a central vent portion thereof. Standoffs 52 depend from the top cover 42 and function to space the top cover 42 above the floor of the threshold portion 27 of the sill and to expose the drain entrances 44 and 46 at floor level when installed. Drain entrances 44 and 46 are defined beneath the end portions of the top cover 42 and are configured to direct water from the threshold portion 27 into first and second drains 48 and 49 respectively. First and second drains 48 and 49 extend downwardly beneath the end portions of the top cover 42 and have internal drain passages 54 and 56 (FIG. 5) that are open at the bottoms and communicate at the tops with drain entrances 44 and 46. The drains 48 and 49 are separated by an open vent space 51 with which the vent holes 43 in the top cover communicate. A depending skirt 59 at the upper extent of the vent space 51 extends at least partially into the oblong hole in which the drain insert is installed to form a dam that prevents water and air from entering or exiting the vent space 51 other than through the vent holes 43. Snap ridges 53 are formed on the drain insert and are configured and positioned to snap in place beneath the rim of the oblong hole to snap and hold the drain insert securely in place in the sill.

Referring to FIG. 5, drain passages 54 and 56 are seen to terminate at the bottom end of the drain insert 41. Vent holes 43 are shown clearly communicating with the vent space 51 that separates the drains 48 and 49. Standoffs 52 as well as skirt 59, which forms the water dam when the insert is installed, also are clearly visible in FIG. 5. The top cover 42 is seen to project laterally beyond the profile of the drains 48 and 49 to define lips 57 and 58 that form part of the drain entrances 44 and 46.

FIG. 6 illustrates the unique configuration of one of the lips 57 on the bottom of the top cover 42. The other lip 58 is a mirror image of the lip 57 illustrated in the figure. The lip 57 is formed with a double chamfer that includes a first chamfer 61 extending around the extreme bottom edge of the lip 57 and a second chamfer 62 that extends inwardly from the first chamfer to a position beyond the upper extent of the drain passage 54 (FIG. 5). This unique double chamfer configuration has been found to prevent the formation of a flow blocking meniscus at the location of the drain entrance when water on the threshold portion of the sill comes into contact with the entrance. Such a meniscus otherwise can form at this location and, due to surface tension at the meniscus, form a meniscus dam that prevents water from flowing into the drain passage 54. With the double chamfer profile, any meniscus that may form does not block the flow and, in fact, may help to guide water into the drain. While the angles of each chamfer are not particularly critical, it has been found that an angle of the first chamfer 61 of about 45 degrees relative to the top cover and an angle of the second chamfer 62 of between about 1 and about 30 degrees functions well to prevent a meniscus block and to direct water freely into the drain passage 54. However, those of skill in the art may choose other angles within the scope of the invention.

Also illustrated in FIG. 6 are the standoffs 52, which extend inwardly to meet each other at the back inner corner of the drain entrance 46 and thereby bound the back and right side of the drain entrance.

Figure 7:
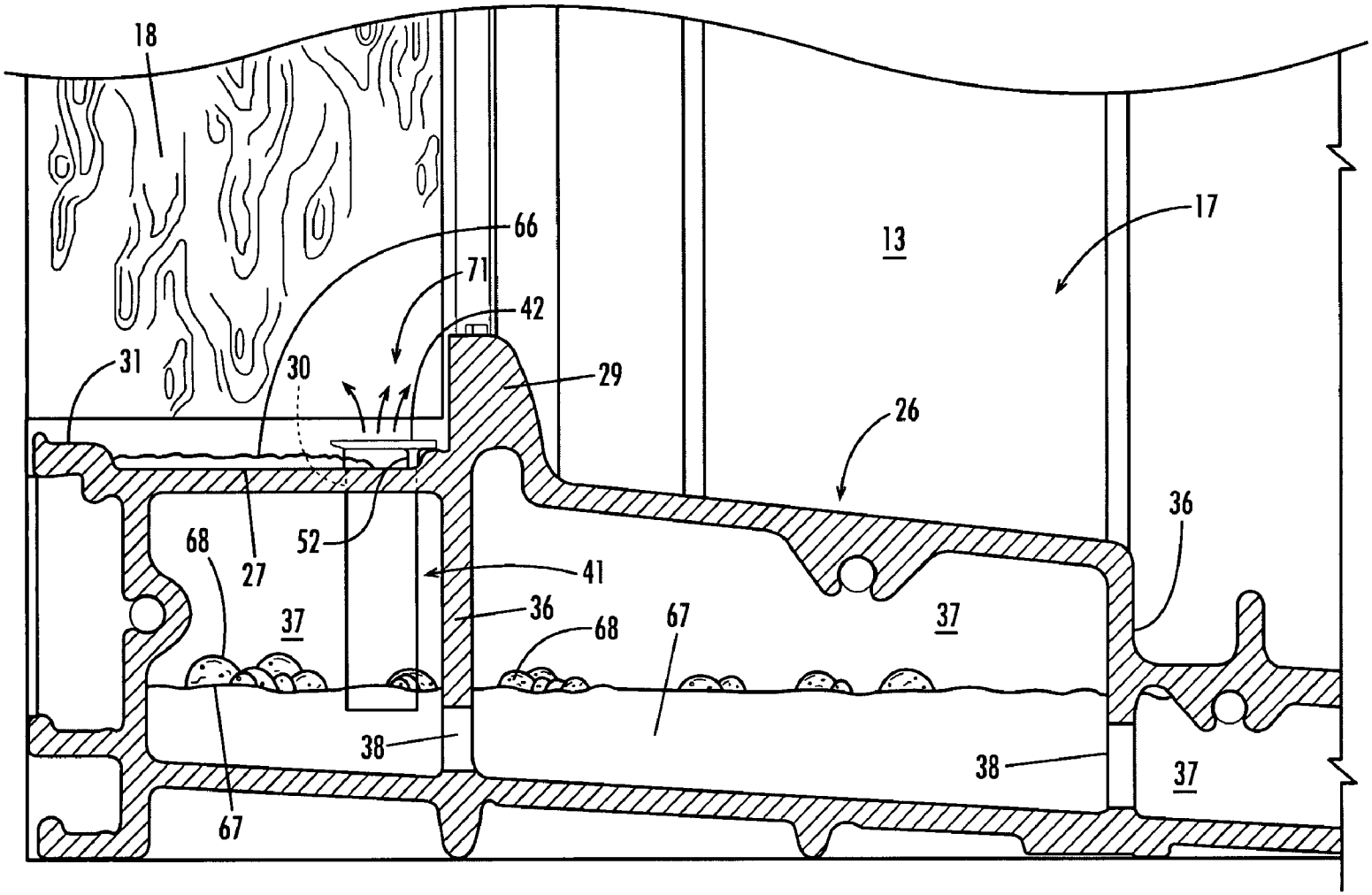
FIG. 7 is a cross-sectional view of the sill portion of a doorway showing water contained in the sill and its interaction with the drain insert according to the invention.

FIG. 7 is a cross-sectional view of a doorway having a contain-and-drain sill equipped with the drain insert according to the invention and illustrates how the invention functions to eliminate bubbling. The sill 17 has a sill deck 26 and a threshold portion 27 bounded along its inside edge by an inside lip 31 and on its outside by weather seal surface 29. Door panel 18 is shown closed against the weather seal surface 29. The sealed interior of the sill 17 is extruded or otherwise formed with support ribs that define within the sill a number of chambers 37. Openings 38 are formed along the support ribs 36 and establish fluid communication and flow paths from the interior most chamber 37 beneath the threshold portion 27 to the exterior nosing of the sill bearing weep holes 24. Thus, water within the interior of the sill can flow freely from any chamber to the exterior nosing and drain out through the weep holes.

The floor of the threshold portion 27 is formed with an oblong opening 30 that receives and holds the drain insert 41 of the invention. The drain insert 41 extends through the opening 30 and into the chamber 37 below to a position slightly above the bottom of the chamber 37 as shown. Standoffs 52 rest on the floor of the threshold portion 27 of the sill and support the top cover 42 of the insert above and spaced from the floor. This both exposes the drain entrances 44 and 46 and positions the vent holes in the top cover 42 a predetermined distance above the floor of the threshold portion 27.

FIG. 7 depicts the doorway and sill as they might appear during a blowing rainstorm. Under these conditions, as discussed above, a pressure differential generally arises between the inside of the doorway and the outside, which creates a partial vacuum in the interior of the sill. This, in turn, sucks rainwater 67 and air into the interior of the sill through the weep holes and the air can form air bubbles 68, which sometimes can virtually take the form of a froth. The level of the water 67 rises within the sill until the head of water equals the difference in pressure between the inside and outside of the doorway. At the same time, relatively smaller volumes of water can leak between the door panel 18 and the weather seals against which it is closed. This water collects in a shallow pool atop the threshold portion of the sill as shown at 66 and must be drained into the interior of the sill, eventually to be drained safely to the outside through the weep holes.

With the conditions depicted in FIG. 7 thus described, the function of the drain insert 41 according to the invention will now be described. The water 66 collecting in the threshold portion of the sill encounters the drain entrances 44 and 46 of the drain insert. Due to the double chamfers 61 and 62 on the underside of the lips 57 (FIG. 6) the water 66 is prevented from forming a flow blocking meniscus dam at the drain doorway, which it otherwise would tend to do. Instead, the water is directed beneath the top cover 42 of the insert and into the drain passages 54 and 56 (FIG. 5). From there, the water flows down the passages 54 and 56 and into the interior of the sill 17.

Simultaneously, air venting from the interior of the sill as a result, for example, of a lower pressure on the interior of the doorway or rising water (and consequent displacement of air) within the sill, must vent through the vent holes 43 in the top cover 42 of the insert, as indicated by arrows 71. This is a situation that, in the prior art, resulted in percolation and bubbling at the vent location. However, since the water from the threshold portion drains through drain passages 54 and 56 that are separate from the vent holes 43, the venting air does not pass through the draining water. As a consequence, percolation and bubbling from this source is eliminated. Further, the standoffs are sized such that the top surface of the cover 42 is positioned higher than the deepest possible pool of water on the threshold portion 27, thus eliminating the possibility that water might overflow the vent holes and cause bubbling.

Percolation and bubbling at the drain site also occurs in the prior art as a result of rising water and bubbles inside the contain-and-drain sill with increasing wind load. Bubbles, indicated at 68 in FIG. 7, form in the rising water 67 as a result of somewhat turbulent air being sucked into the sill along with water, perhaps aided by small amounts of foam forming contaminants such as detergents. As the water and bubbles rise, the bubbles can spill out through prior art vent openings aided by the flow of air through these openings. This source of bubbling also is eliminated in the present invention. Specifically, as the water 67 rises, it soon contacts the bottom ends of the drain passages sealing them off from any bubbles that may have formed on the surface of the water. Since the vent space 51 is still open, however, additional air that is displaced by the rising water and air being sucked through the sill is free to exit the chamber 37 at a very high location; i.e., the height of the top cover 42 above the threshold portion 27. This both equalizes the pressure within the chamber 37 preventing air and water from being blown up the drain passages by chamber pressure and insures that any bubbles on the surface of the water do not easily reach the vent holes 71. The result is a contain-and-drain sill that does not exhibit unwanted percolation and bubbling that has plagued the prior art.

The drain insert of the present invention can be formed of a variety of materials such as, for instance, ABS plastic, other moldable plastic material, aluminum or the like. However, it has been found that a more durable material such as nylon is highly resistant to damage, does not absorb moisture, is easily installed, and has inherent hydrophobic properties aid the drainage of water from the threshold portion of the sill through the drain openings.

The invention has been described above in terms of a preferred embodiment that illustrates the best mode known to the inventors of carrying out the invention. Skilled artisans will recognize, however, that the invention can be embodied in a variety of different forms and configurations without departing from the scope of the invention. Contain-and-drain sills, for instance, can be formed in a range of configurations and sizes and from a variety of materials. While the invention has been described within the context of an in-swing door, it may be also be applicable to out-swing doors as well as sliding doors. Indeed, the present invention may be applied to windows and window sills as well as doorways. Further, while the preferred embodiment illustrated above includes two drains and one vent, this should not be construed as a limitation. The invention might, for example, be embodied in an insert with more or less than two drains, more than one vent, or any combination thereof, and all such configurations are contemplated by the invention. In addition, while the preferred embodiment is configured to be installed in an oblong hole in the sill, it might also be configured to fit in a round hole, a square hole, or any other shape hole as desired. The invention also might be configured and sized to be installed as a retrofit drain insert in existing doorway sills by, for example, replacing the existing drain cover with an insert according to the invention. These and other additions, deletions, and modifications to the illustrated embodiment might well be made by those of skill in the art without departing from the spirit and scope of the invention as set forth in the claims.

What is claimed is:

1. A doorway separating inside from outside and comprising:

spaced vertically extending side jambs having top ends and bottom ends;

a head jamb extending between the top ends of the side jambs;

a sill having a generally hollow interior and extending between the bottom ends of the side jambs;

the sill having a threshold portion defining a floor;

the side jambs, head jamb, and sill forming a frame;

at least one door panel closably mounted in the frame and, when closed, overlying the floor of the threshold portion of the sill;

at least one weep hole in the sill communicating between the hollow interior of the sill and the outside;

a drain insert extending through the threshold portion of the sill into the interior of the sill, the drain insert defining at least one drain passage communicating with the interior of the sill and at least one vent space communicating with the interior of the sill, the at least one vent space being separated from the at least one drain passage to isolate the at least one vent space and the at least one drain passage from each other;

the drain insert having a top cover spaced above the floor of the sill and defining at least one drain entrance below the top cover and above the floor of the threshold portion of the sill; the at least one drain entrance communicating with the at least one drain passage; and at least one vent hole formed in the top cover of the drain insert and communicating with the at least one vent space, the at least one vent hole being spaced higher than the at least one drain entrance.

2. A doorway as claimed in claim 1 and wherein the at least one drain passage communicates with the interior of the sill at a first location and the at least one vent space communicates with the interior of the sill at a second location, the second location being higher than the first location.

3. A doorway as claimed in claim 1 and wherein the at least one drain passage comprises two drain passages and wherein the at least one drain entrance comprises two drain entrances each communicating with a respective one of the drain passages.

4. A doorway as claimed in claim 3 and wherein the top cover has ends and wherein the two drain passages are defined below the ends of the top cover and above the floor of the threshold portion of the sill.

5. A doorway as claimed in claim 4 and wherein the vent space is defined between the two drain passages.

6. A doorway as claimed in claim 5 and wherein the two drain passages communicate with the interior of the sill at first locations and the at least one vent space communicates with the interior of the sill at a second location, the second location being higher than the first location.

7. A doorway as claimed in claim 1 and further comprising a meniscus inhibiting feature formed at the drain entrances.

8. A doorway as claimed in claim 7 and wherein the meniscus inhibiting feature comprises at least one chamfer formed on a bottom edge of the top cover above the drain entrance.

9. A doorway as claimed in claim 8 and wherein the at least one chamfer comprises a double chamfer.

* * * * *